US006377145B1

(12) United States Patent
Kumagai

(10) Patent No.: US 6,377,145 B1
(45) **Date of Patent: *Apr. 23, 2002**

(54) VIBRATION ACTUATOR HAVING MAGNETIC CIRCUIT ELASTICALLY SUPPORTED BY A SPIRAL DAMPER WITH INCREASED COMPLIANCE

(75) Inventor: Toru Kumagai, Shiroishi (JP)

(73) Assignee: Tokin Corporation, Miyagi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/673,863

(22) PCT Filed: Mar. 3, 2000

(86) PCT No.: PCT/JP00/01287

§ 371 Date: Oct. 19, 2000

§ 102(e) Date: Oct. 19, 2000

(87) PCT Pub. No.: WO00/52961

PCT Pub. Date: Sep. 8, 2000

(30) Foreign Application Priority Data

Mar. 3, 1999 (JP) ..... 11-055634

(51) Int. Cl.[7] ..... H01F 7/08; H01F 7/13

(52) U.S. Cl. ..... 335/274; 310/29; 310/36; 310/81; 310/322; 381/423; 381/429

(58) Field of Search ..... 340/407.1, 825.44, 340/825.46; 335/27 A; 310/29, 36, 13, 81, 268, 322; 381/398, 423, 429; 455/567

(56) References Cited

U.S. PATENT DOCUMENTS 5,682,132 A 10/1997 Hiroyoshi et al. ..... 340/407.1

6,127,750 A * 10/2000 Dadd ..... 310/13

FOREIGN PATENT DOCUMENTS

| | | | |
|---|---|---|---|
| DE | 3621133 | * | 1/1988 |
| JP | 10-165892 | | 6/1998 |
| JP | 11-27921 | | 1/1999 |
| WO | WO 98/34320 | | 8/1998 |

* cited by examiner

*Primary Examiner*—Ramon M. Barrera
(74) *Attorney, Agent, or Firm*—Frishauf, Holtz, Goodman, Langer & Chick, P.C.

(57) ABSTRACT

A vibration actuator includes an electromechanical transducer having a magnetic circuit (1-4) and a driving coil (5), a support frame (9), and a damper (270) elastically supporting the magnetic circuit onto the support frame to flexibly damp the vibration of the magnetic circuit when a driving AC current is supplied to the coil (5). The damper (270) comprises inner and outer ring portions (271, 272) and a plurality of spiral spring portions (273) determined by a plurality of spiral slits (274, 275) formed in the damper. In order to reduce the spiral spring portion determined by the adjacent two spiral slits in its compliance, each of the spiral spring portions has an effective spring length determined by an effective angle (θ) which is determined as an angle (by angular degree) from an inner end of the inner spiral slit to an outer end of the outer spiral slit defining each respective spiral spring portion around a center of the damper. The effective angle is 55 angular degree or more. In a preferable example, the effective spring length is determined by a product (r·θ) of an average radius (r) value by the unit of "mm" and the effective angle (θ) value by unit of the angular degree. The effective spring length is selected to 320 or more, and preferably 400 or more.

7 Claims, 3 Drawing Sheets

VIBRATION ACTUATOR HAVING MAGNETIC CIRCUIT ELASTICALLY SUPPORTED BY A SPIRAL DAMPER WITH INCREASED COMPLIANCE

TECHNICAL FIELD

This invention relates to a vibration actuator using an electro-mechanical transducer including a magnetic circuit and a driving coil and having a damper elastically supporting the magnetic circuit, and in particular to a structure of the damper.

BACKGROUND ART

An electro-dynamic type of the electromechanical transducer comprises a magnetic circuit comprising a magnet and magnetic yoke and having a magnetic gap therein, and a moving coil or ribbon disposed in the magnetic gap. When a driving AC current is applied to the moving coil or ribbon, the moving coil or ribbon vibrates relatively to the magnetic circuit. A frequency of the vibration is dependent on a frequency of the driving AC current. Since the moving coil or ribbon is applied with the driving AC current and moves or vibrates, it is referred to as a driving coil and also a moving element.

When the driving AC current is of an audio frequency, the moving coil or ribbon vibrates at the audio frequency. When a thin plate or diaphragm is connected to the moving coil or ribbon directly or through the damper, it is vibrated at the audio frequency to produce sound. This is well known as an electro-dynamic speaker.

On the other hand, an electromagnetic type of the electromechanical transducer comprises a magnetic circuit comprising a magnet, magnetic yoke and a driving coil wound on the magnetic yoke and having a magnetic gap formed therein, and a magnetic armature or a small magnetic piece as a moving element disposed in the magnetic gap. When the driving AC current is applied to the driving coil, the magnetic armature vibrates at a frequency of the driving AC current. The electromagnetic type transducer is also used for a speaker where the magnetic armature is connected to a diaphragm or a thin plate.

In the electromechanical transducer of either one of the two types described above, the magnetic circuit can be vibrated at a low frequency which is lower than the audio frequency by supporting the magnetic circuit through a damper onto a rigid support member or frame, by fixing the moving element to the support member directly or through a low compliant elastic member, and by applying to the driving coil a driving AC current of the low frequency. The vibration is transmitted to the support member through the damper. Therefore, when a person attaches the support member or a material fixed to the support, he can feel the vibration through his skin. Thus, the transducer can be used in a vibration actuator for producing a low frequency vibration which a human body can feel through a skin.

In such a vibration actuator, when a driving AC current of the audio frequency is applied to the driving coil, the moving element vibrates at the audio frequency. The vibration is transmitted to the support member. When a thin plate or a diaphragm is joined to the support member, it vibrates to produce an audible sound. Using this principle, a small-size vibration actuator is proposed for producing a voice and a ringing tone, as well as signaling vibration for announcement of call reception in mobile communication (for example, see Japanese Unexamined Patent Applications (JP-A) No. H10-165892 and No. H11-027921.

These Japanese publications disclose a damper having spiral a spring portions for supporting the magnetic circuit as shown in FIG. 5 of JP-A'892 and also in FIG. 5. of JP-A'921. The damper is made of an elastic disk such as a metal plate and comprises an inner ring portion, outer ring portion and a plurality of spiral spring portions connecting between the inner and outer ring portions. The inner ring and the outer ring are fixed to the magnetic circuit and the support frame, respectively.

Each of the spiral spring portions extends from the inner ring portion to the outer ring portion in spiral shape and is defined by an inner spiral slit and an outer spiral slit In the structure, even if the damper is limited in its radius, each of the spiral spring portions has a long size comparing radial spring arms formed within the limited radius. Therefore, the magnetic circuit can be elastically supported by the spring portions with a high compliance comparing with the limited radius of the damper.

In an existing one of the damper having the spiral spring portions, an effective spring length of the spiral spring portion is mainly determined by an angle around a center of the damper from an inner end of the inner spiral slit to an outer end of the outer spiral slit. The angle is hereinafter referred to as "effective angle". It has been considered to be sufficient to elastically support the magnetic circuit with a relatively high compliance that the effective angle is 55 angular degree at the maximum. The effective angle has been usually selected to be an angle smaller than 55 angular degrees, considering that use of a large effective angle makes it difficult to produce the damper.

However, the above-mentioned existing vibration actuator is disadvantageous in that the damper may often suffer a permanent strain if an abnormal stress is applied by external shock or the like.

After studying the reason of the problem caused, the inventor knew that the existing damper having spiral spring portions with the effective angle smaller than 55 angular degrees cannot provide a sufficient high compliance against any relatively large external force caused due to mechanical shock such as dropping but still exhibits a relatively large stiffness in the radial direction. If subjected to such a large external stress, for example, when the vibration actuator is dropped, the magnetic circuit may abnormally be displaced in the radial direction. Such abnormal displacement may leave the permanent strain in the damper and may further cause the inclination of the center shaft of the magnetic circuit. In case where the strain or the inclination is great, the abnormal stress is applied to the damper so that the stability in characteristics would be deteriorated.

DISCLOSURE OF INVENTION

It is therefore an object of the present invention to provide a vibration actuator which is capable of improving a shock resistance to keep stable characteristics and high reliability over a long period of time.

This invention is applicable to a vibration actuator having an electro-mechanical transducer including a driving coil and a magnetic circuit comprising a magnet and yoke. The vibration actuator comprises a support frame and a damper supporting the magnetic circuit onto the support frame. The damper comprises an inner ring portion, an outer ring portion, and a plurality of spiral spring portions connecting the inner and outer rings. Each of the spiral spring portions extends in a spiral shape from the inner ring portion to the outer ring portion and is defined by an inner spiral slit and an outer spiral slit. The damper is characterized in that the effective angle is selected to be an angle larger than 55 angular degrees.

This invention is applicable to a vibration actuator having an electro-mechanical transducer including a driving coil and a magnetic circuit comprising a magnet and yoke. The vibration actuator comprises a support frame and a damper supporting the magnetic circuit onto the support frame. The damper comprises an inner ring portion, an outer ring portion, and a plurality of spiral spring portions connecting the inner and outer rings. Each of the spiral spring portions extends in a spiral shape from the inner ring portion to the outer ring portion and is defined by an inner spiral slit and an outer spiral slit. Each of the spiral spring portions has an effective spring length of 320 or more, preferably, 400 or more. The effective spring length is determined by a product ($r \cdot \theta$) of an average radius (r) and an effective angle ($\theta$) of the spiral spring portion.

The effective angle is determined as an angle (by angular degree) from an inner end of the inner spiral slit to an outer end of the outer spiral slit defining each respective spiral spring portion around a center of the damper.

The average radius (r) is determined by an average of various distances from the damper center to various points on a spiral curve extending along a central line between the inner and outer spiral slits from an inner end to an outer end of the spiral spring portions, that is, from a home angular position of the effective angle to a terminal angular position moved by an angle of the effective angle $\theta$.

The average radius is approximately given by an average ($(D0+D\theta)/2$) of one (D0) of the various distances at the home angular position of the effective angle and another ($D\theta$) at the terminal angular position.

Alternatively, the average radius is approximately given by one (Dm) of the various distances at an angular position moved by an angle of $\theta/2$ from the home angular position to the terminal angular position, that is, a distance from the damper center to a midpoint on the spiral curve between the home angular position and the terminal angular position.

With the above-mentioned structure, the effective spring length of the spiral spring portion can be increased so that the stiffness of the damper for the radial shock is reduced. As a result, even if the external stress is applied in the radial direction, for example, when the vibration actuator is dropped, the magnetic circuit is only temporarily displaced in the radial direction and is free from any permanent strain.

Preferably, the damper is formed by at least one non-magnetic metal plate selected from SUS304, SUS301, nickel silver, phosphor bronze, and a Be-Cu alloy or an elastic plastic resin. Preferably, the slits determining the spiral spring portions are formed in a disk of the metal plate and are arranged at a predetermined interval from one another.

BEST MODES FOR CARRYING OUT THE INVENTION

Prior to description of preferred embodiments of this invention, an existing vibration actuator will be described with reference to FIGS. 1A and 1B, so as to facilitate understanding of this invention.

Figure 1A:
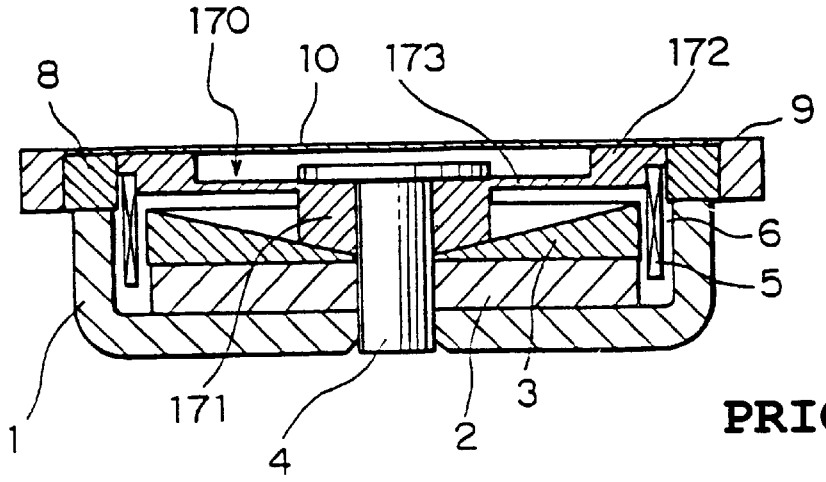
PRIOR ART FIG. 1A
FIG. 1A is a cross-sectional view of an existing vibration actuator.

Referring to FIG. 1A, the vibration actuator shown therein has an electro-mechanical transducer of the electro-dynamic type and has a cylindrical shape with a center shaft 4. Around the center shaft 4, a magnetic circuit is formed by a yoke 1 having a peripheral side wall, a plate 3 arranged inside the yoke 1, and a disk-shaped permanent magnet 2 interposed between the yoke 1 and the plate 3. The permanent magnet 2 and the plate 3 are surrounded by the peripheral side wall of the yoke 1 and a magnetic gap is 6 left therebetween. A driving coil or moving coil 5 is disposed in the magnetic gap 6.

A disk-shape damper 170 supports the magnetic circuit 1-4 on a support frame 9. The damper 170 comprises an inner ring portion 171, an outer ring portion 172 and a plurality of spiral spring portions 173 connecting the inner and outer ring portions 171 and 172 to each other. Each of the spiral spring portions 173 is determined by its inner spiral slit 174 and its outer spiral slit 175. An angle around a center axis of the damper 170 from an inner end of the inner spiral slit 174 and an outer end of the outer spiral slit 175 is selected smaller than 55 angular degrees.

The center shaft 4 is in a form of a bolt and fit into a center hole in the magnetic circuit 1-4 through a center hole of the inner ring portion 171 of the damper 170. Therefore, the magnetic circuit 1-4 and the damper 170 are disposed coaxial with each other, and the magnetic circuit 1-4 is fixedly attached to a lower surface of the inner ring portion 171 at a center of the magnetic circuit and at the side of the plate 3. The outer ring portion 172 is fixed to the support frame 9. Accordingly, the magnetic circuit 1-4 is elastically supported on the support frame 9 by the damper 170.

The driving coil 6 is fixed onto a lower surface of the outer ring portion 172 by means of bonding or adhesive agent. A buffer member or shock absorber 8 is disposed between the support frame 9 and the outer ring portion 172 and is fixed to both of them by means of bonding or adhesive agent. The buffer member 8 prevents generation of noise resulting from collision between an upper end of the side wall of the yoke 1 and the support frame 9 during vibration of the magnetic circuit 1-4.

The support frame 9 is in a form of a ring and is made of a plastic resin or other rigid material. A thin plate cover 10 as a vibration plate is mounted on the support frame 9 and disposed over the damper 170. The thin plate cover 10 can be made of the same material of the support frame into a single part.

In operation, when a driving AC current of the lower frequency is supplied to the driving coil 5, the magnetic circuit 1-4 reciprocatingly moves or vibrates in an axial direction of the center shaft 4 because it is flexibly supported by the elasticity of the spiral spring portion 173 with a relatively high compliance. The vibration is transmitted through the damper 170 to the support 9 and the thin plate cover 10. Therefore, the human body attaching the support frame 9 and/or thin plate cover 10 can detect the vibration.

When the driving AC current has an audio frequency, not the magnetic circuit but the driving coil 5 vibrates at the audio frequency, because the magnetic circuit is supported by the damper 170 having the high compliance. The vibration of the driving coil 5 is transmitted to the thin plate cover 10 through the outer ring 172 and/or the support frame 9. Thus, the thin plate cover 10 vibrates at the audio frequency and produces audible sound.

Figure 1B:
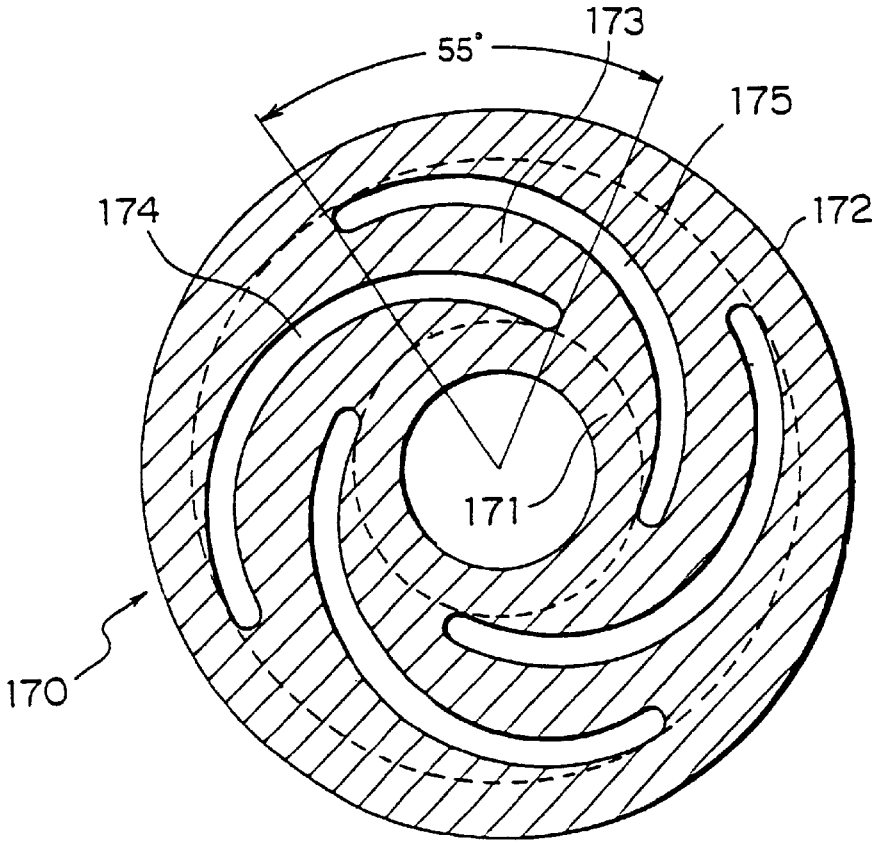
PRIOR ART FIG. 1B
FIG. 1B is a plan view of a damper illustrated in FIG. 1A.

The existing vibration actuator shown in FIGS. 1A and 1B has the problems as described in the preamble.

Now, embodiments of this invention will be described in detail with reference to the drawing.

Figure 2A:
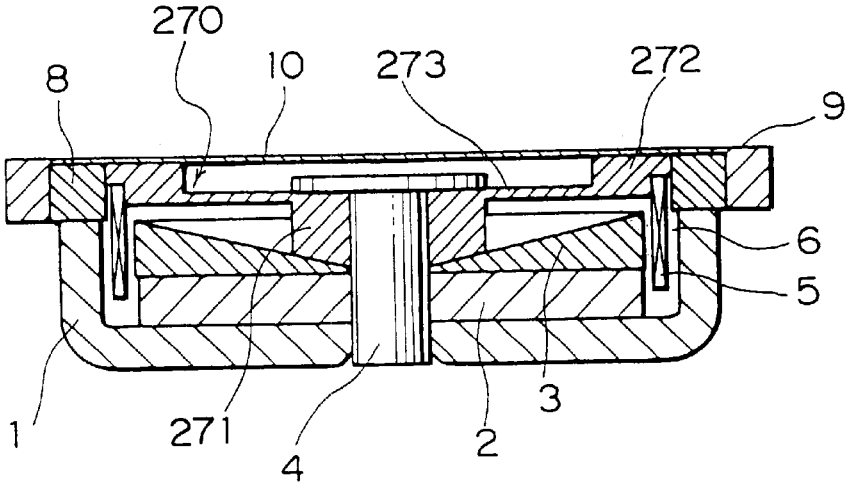
FIG. 2A is a cross-sectional view of a vibration actuator according to an embodiment of this invention.
Figure 2B:
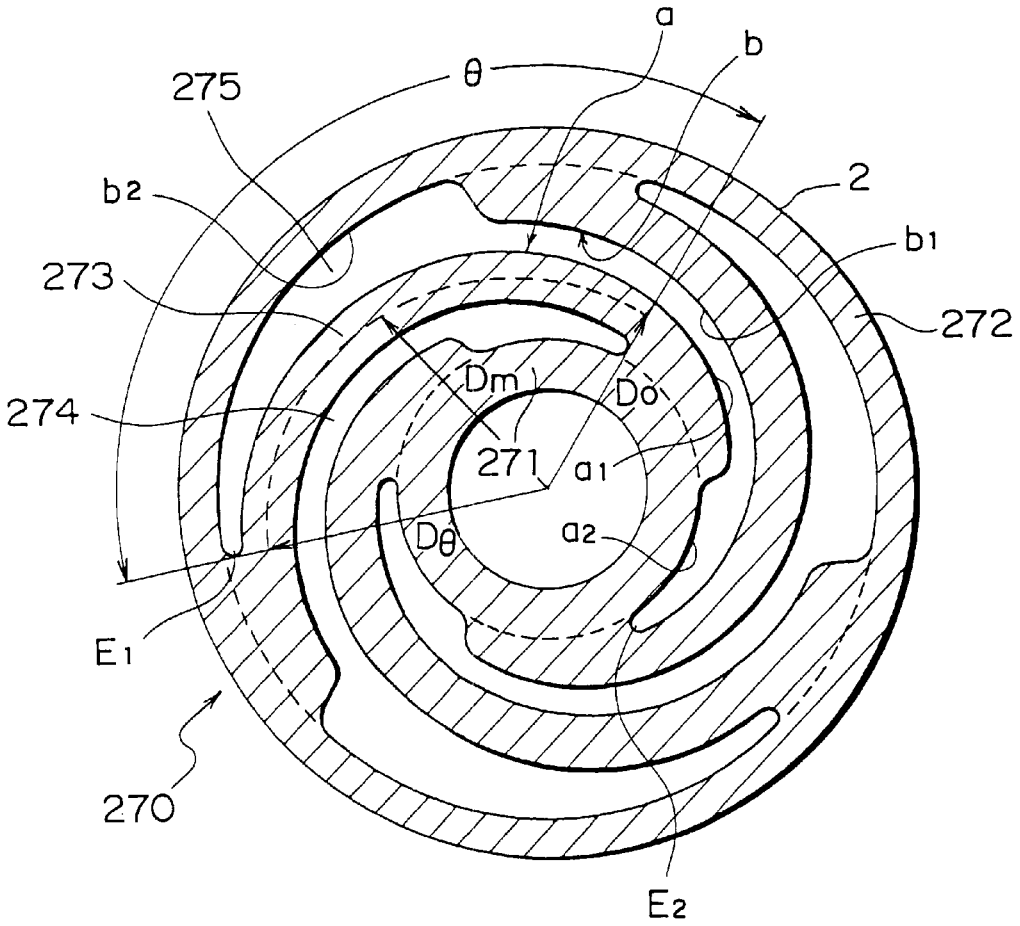
FIG. 2B is a plan view of a damper illustrated in FIG. 2A.

Referring to FIGS. 2A and 2B, a vibration actuator according to one embodiment of this invention is substantially similar to the existing one as shown in FIGS. 1A and 1B and comprises a yoke 1, a permanent magnet 2, a plate 3, a center shaft 4, a coil 5, a damper 270, a shock absorber 8, a support 9, and a thin plate cover 10. The similar parts are represented by the same reference symbols and are not again described in detail.

The damper 270 is essentially similar to the prior damper 170 in that it comprises an outer ring portion, an inner ring portion, and a plurality of spiral spring portions each of which is determined by an inner and an outer spiral slits extending therealong from the inner ring portion to the outer ring portion. In FIG. 2, the inner ring portion, the outer ring portion, the spiral spring portions, and the inner and outer spiral slits are represented by reference numerals 271, 272, 273, 274 and 265, respectively. The inner ring portion 271 and the outer ring portion 272 are fixed to the magnetic circuit 1-4 and the support frame 9, respectively.

The damper 270 may be made of at least one elastic non-magnetic material selected from SUS304, SUS301, nickel silver, phosphor bronze, a Be-Cu alloy, and plastic resin having elasticity.

Now, description will be made as to an aspect of the spiral spring portion 273 which is a characteristic of the present invention.

As illustrated in FIG. 2B, the damper 270 is provided with a plurality of slits (three is shown). Each of these three spiral slits spirally extends from the inner ring portion 271 to the outer ring portion 272 and over an angular region of 180 degrees or more around the center of the damper 270. Those three spiral slits are equi-angularly arranged around the center of the damper. Adjacent two of the three spiral slits in the radial direction determine one of the three spiral spring portions therebetween. In the figure, reference numerals 274 and 275 represent the two spiral slits determining a particular one of the spiral spring portions 273.

Each of the spiral spring portions 273 has an effective angle Θ of 55 angular degrees or more. The effective angle Θ is an angle between an inner end of the inner spiral slit 274 and an outer end of the outer spiral slit determining each one of the spiral spring portions 273.

Further, each of the spiral spring portions 273 has an effective spring length of 320 or more, preferably, 400 or more.

Herein, the effective spring length is determined by a product ($r \cdot \theta$) of an average radius (r) and an effective angle (θ) of the spiral spring portion. The average radius (r) is determined by an average of various distances (by a unit of "mm") from the damper center to various points on a spiral curve (which is shown by an dotted line shown in the spiral spring portion 273 in FIG. 2B) extending along a central line between the inner and outer spiral slits 274 and 275 from an inner end to an outer end of the spiral spring portion 273, that is, from a home angular position of the effective angle to a terminal angular position moved by an angle of the effective angle θ.

The average radius is approximately given by an average ($(D0+D\theta)/2$) of one (D0) of the various distances at the home angular position of the effective angle and another (Dθ) at the terminal angular position.

Alternatively, the average radius is approximately given by one (Dm) of the various distances at an angular position moved by an angle of θ/2 from the home angular position to the terminal angular position, that is, a distance from the damper center to a midpoint on the spiral curve between the home angular position and the terminal angular position.

As illustrated in FIG. 2B, each of the spiral slits (a particular one 275 is representatively illustrated) has a shape determined by an radial inner contour line a and a radial outer contour line b so that the slit width of the spiral slit is increased at the inner and outer end portions. The radial inner contour line a comprises a spiral line al extending from an outer end E1 toward the inner end E2 of the slit and a circular arc a2 in the vicinity of the inner end, the circular arc a2 being concentric with the inner ring portion 171. The radial outer contour line b comprises a spiral line b1 extending from the inner end E2 toward the outer end E1 of the slit and a circular arc b2 in the vicinity of the outer end, the circular arc b2 being concentric with the outer ring portion 172. The abovementioned configuration of the spiral slit contributes to further reduction in the amount of the material of the damper 270 left between the inner ring 271 and the outer ring 272. Therefore, rigidity of the spiral spring portion 273 and the radial rigidity of the damper are reduced.

In the above-mentioned structure, the vibration actuator operates in the manner similar to the prior art one when the driving AC current is applied to the driving coil 5. Since each of the spiral spring portions has an effective spring length increase and relatively high compliance, the magnetic circuit can vibrate with a relatively large amplitude and can therefore be reduced in size and weight.

In the case where the magnetic circuit is subjected to any radial external force, for example, when the vibration actuator is dropped, the magnetic circuit is displaced in the radial direction. Even in this event, the damper itself and spiral spring portions are free from any permanent strain because they have the radial rigidity reduced.

In the embodiment of FIGS. 2A and 213, the thin cover plate 10 is fixed to or integrally formed with the support frame 9. However, the cover plate 10 can be omitted in a modification. In this case, an apparatus to which the vibration actuator is mounted has a diaphragm or other thin plate which receives vibration of the coil through the support frame and produces a sound due to the vibration.

The damper 270 in FIGS. 2A and 2B has the inner and outer ring portions 271 and 272 which are shown to have axial length larger than the thickness of the spring portions 273. Thus, the inner ring portion 271 is a center rib, hub or boss of the damper 270 and the outer ring portion 272 is an outer rib or rim. However, the inner and outer ring portions 271 and 272 can be formed to have the thickness equal to that of the spiral spring portion 273, in a modification of the damper.

Further, the shock absorber 8 can be omitted in an arrangement of the support frame 9 and the yoke 1 where the yoke 1 does not collide to the support frame 9 when the magnetic circuit 1-4 vibrates.

Figure 3:
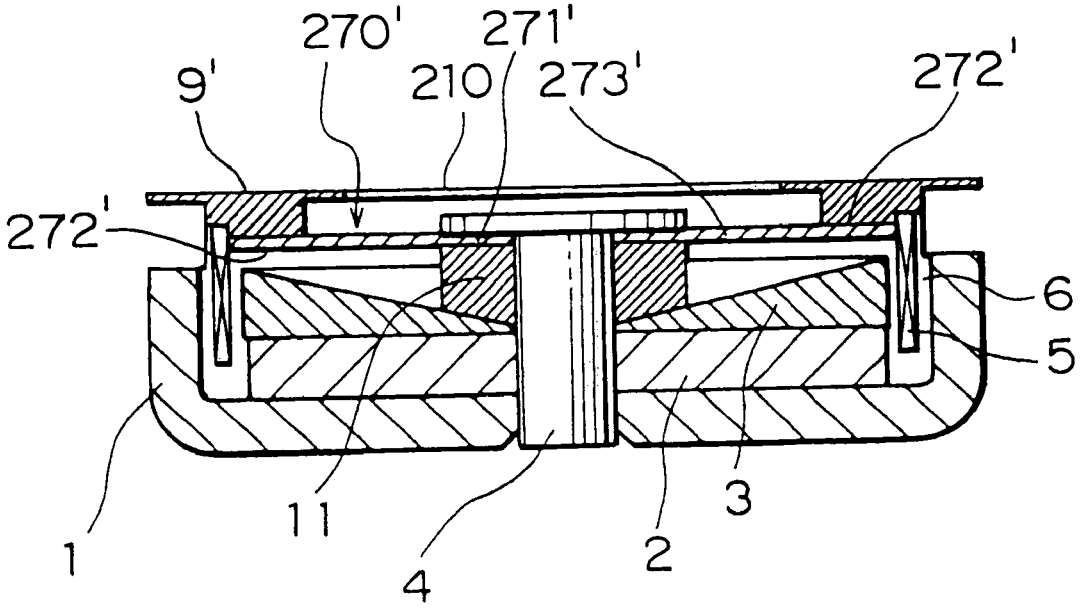
FIG. 3 is a cross-sectional view of a vibration actuator according to another embodiment of this invention.

Referring to FIG. 3, the vibration actuator according to another embodiment shown therein includes all of the modification described above. The support frame shown at 9' is in a ring shape and is not provided with a thin cover plate. The damper shown at 270' is formed from a thin elastic plate so that inner and outer ring portions shown at 271' and 272' have the same thickness of the spiral spring portion shown at 273'. The inner ring portion 271' is fixed to the magnetic circuit 1-4 by use of the center shaft 4 like a bolt through an elastic spacer 11 which is disposed and clamped between the inner ring portion 271' and the magnetic circuit 1-4, specifically, the magnetic plate 3. The outer ring portion 272' is fixed to the lower surface of the support frame 9', so that the support frame is disposed over the damper 270'. In the arrangement of the support frame, the yoke 1 does not collide to the support frame 270'. Therefore, the shock absorber is omitted.

This damper 270' is made of a plate of the material described above, by punching method. The thickness of the plate is dependent of the size of actuator. In use for a ringing actuator assembled in a cellular a mobile telephone set such as a cellular telephone set, it is preferably about 0.1–0.3 mm.

Samples of the vibration actuator having the structure of FIG. 3 and a size of outer diameter of 15 mm were produced with different dampers which are made of various materials described above and have different effective spring lengths. Those samples were subjected to the drop test where each sample was attached with a stopper necessary for vibrating and fixedly mounted in a plastic case having a weight of 100 grams, then dropped on a concrete floor from a height of 1.8 meters. Deformation of dampers of the dropped samples were observed. Test results are exemplarily demonstrated for dampers made of SUS304 in Table 1.

TABLE 1

| Average radius (r) | | | 4 | | | 6.5 |
|---|---|---|---|---|---|---|
| Effective angle (θ) | 55 | 80 | 100 | 130 | 160 | 80 |
| Effective length (r · θ) | 220 | 320 | 400 | 520 | 640 | 520 |
| Resistance for dropping | x | Δ | ○ | ○ | ○ | ○ |

In Table 1, the average radius (r) is based on the distance (Dm) at the middle angle position. Marks x, Δ and ○ represent large deformation of damper caused by the drop test, small deformation of the damper caused by the drop test but the damper being still usable, and no deformation of the damper caused by the drop test.

It is understood from table 1 that the effective length is advantageously 320 or more, and preferably, 400 or more.

What is claimed is:

1. A vibration actuator comprising:

an electro-mechanical transducer including a driving coil and a magnetic circuit comprising a magnet and yoke, a support frame, and a damper supporting the magnetic circuit onto the support frame, said damper comprising an inner ring portion, an outer ring portion, and a plurality of spiral spring portions connecting the inner and outer ring portions, wherein each of the spiral spring portions extends in a spiral shape from the inner ring portion to the outer ring portion and is defined by an inner spiral slit and an outer spiral slit, wherein each of the spiral spring portions has an effective spring length of at least 320 (mm·degrees), said effective spring length being determined by a product (r·θ) of an average radius (r) (in mm) and an effective angle (θ) of each respective spiral spring portion, and said effective angle being determined as an angle (by angular degree) from an inner end of the inner spiral slit defining each respective spiral spring portion to an outer end of the outer spiral slit defining each respective spiral spring portion around a center of the damper, and wherein:

each of said spiral slits has a shape determined by a radial inner contour line and a radial outer contour line so that a slit width of each respective spiral slit is increased at the inner and outer end portions, said radial inner contour line comprises a spiral line extending from the outer end toward the inner end of each respective slit and a circular arc in a vicinity of the inner end, the circular arc being concentric with the inner ring portion, and said radial outer contour line comprises a spiral line extending from the inner end toward the outer end of each respective slit and a circular arc in a vicinity of the outer end, the circular arc being concentric with the outer ring portion.

2. A vibration actuator as claimed in claim 1, wherein the effective spring length of each of the spiral spring portions is at least 400 (mm·degrees).

3. A vibration actuator as claimed in claim 1, wherein said average radius (r) is determined by an average of various distances (by a unit of "mm") from the center of the damper to various points on a spiral curve extending along a central line between the inner and outer spiral slits from an inner end to an outer end of the spiral spring portions, that is, from a home angular position of the effective angle to a terminal angular position moved by an angle of the effective angle θ.

4. A vibration actuator as claimed in claim 3, wherein said average radius is approximately given by an average (D0+Dθ)/2) of one (D0) of the various distances at the home angular position of the effective angle and another one (Dθ) of the various distances at the terminal angular position.

5. A vibration actuator as claimed in claim 3, wherein said average radius is approximately given by one (Dm) of the various distances at an angular position moved by an angle of θ/2 from the home angular position to the terminal angular position, that is, a distance from the center of the damper to a midpoint on the spiral curve between the home angular position and the terminal angular position.

6. A vibration actuator as claimed in claim 1, wherein said damper comprises at least one metal material selected from SUS304, SUS301, nickel silver, phosphor bronze, and a Be—Cu alloy.

7. A vibration actuator as claimed in claim 1, wherein said spiral slits determining said spiral spring portions are equiangularly formed around the center of said damper.

* * * * *